US008616393B2

(12) United States Patent
Vessa

(10) Patent No.: US 8,616,393 B2
(45) Date of Patent: Dec. 31, 2013

(54) MEDICATION DELIVERY CONTROL SYSTEMS AND METHODS

(75) Inventor: Matthew Vessa, Jersey City, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 2385 days.

(21) Appl. No.: 11/423,487

(22) Filed: Jun. 12, 2006

(65) Prior Publication Data

US 2008/0121000 A1 May 29, 2008

(51) Int. Cl.
*B65D 55/14* (2006.01)
*E05B 65/00* (2006.01)

(52) U.S. Cl.
USPC ..... 215/207; 70/63; 70/158; 70/77

(58) Field of Classification Search
USPC ..... 70/63, 158, 163, 165–173, 340–343, 70/432, 436, 77; 604/500; 215/207, 215
See application file for complete search history.

(56) References Cited

U.S. PATENT DOCUMENTS

| | | | | | |
|---|---|---|---|---|---|
| 2,220,937 | A | * | 11/1940 | Machinist | 235/1 R |
| 3,820,654 | A | | 6/1974 | Colella | |
| RE28,861 | E | | 6/1976 | Hall, Jr. | |
| 3,973,687 | A | | 8/1976 | Glick | |
| 4,233,799 | A | * | 11/1980 | Caille | 53/154 |
| 4,281,771 | A | | 8/1981 | Siegel | |
| 4,496,065 | A | | 1/1985 | Nagy | |
| 4,775,061 | A | * | 10/1988 | Coote | 215/215 |
| 4,984,698 | A | | 1/1991 | Stuckey | |
| 5,000,019 | A | * | 3/1991 | Foster | 70/338 |
| 5,464,114 | A | | 11/1995 | Green | |
| 5,509,550 | A | | 4/1996 | DeJonge | |
| 5,586,670 | A | | 12/1996 | Greenwald | |
| 5,699,922 | A | | 12/1997 | Harding | |
| 5,950,630 | A | | 9/1999 | Portwood et al. | |
| 6,029,834 | A | | 2/2000 | Sanner | |
| 6,082,564 | A | | 7/2000 | Trout | |
| 6,382,416 | B1 | | 5/2002 | Gainey | |
| 6,421,650 | B1 | | 7/2002 | Goetz et al. | |
| 6,519,569 | B1 | | 2/2003 | White et al. | |
| 6,604,643 | B1 | * | 8/2003 | Michael et al. | 215/204 |
| 6,910,626 | B2 | | 6/2005 | Walsh | |
| 6,912,878 | B2 | * | 7/2005 | Belden, Jr. | 70/57.1 |

FOREIGN PATENT DOCUMENTS

| | | |
|---|---|---|
| EP | 0071931 | 2/1983 |
| GB | 2412367 | 9/2005 |
| WO | WO-02/14635 | 2/2002 |
| WO | WO-02/15957 | 2/2002 |
| WO | WO-02/088498 | 11/2002 |

* cited by examiner

*Primary Examiner* — Emily Schmidt
*Assistant Examiner* — Bradley G Thomas, Jr.
(74) *Attorney, Agent, or Firm* — Servilla Whitney LLC

(57) ABSTRACT

Drug delivery systems and methods involve associating unique keys to patients. Medication intended for a patient is then locked in a container that may only be unlocked with the particular unique key associated with that patient or a master key. The master key may have a counter to count the number of times that it is used, so as to discourage unnecessary use of the master key. The medication containers may be locked with template locks that are subsequently encoded to be unlocked by a particular unique key.

11 Claims, 11 Drawing Sheets

MEDICATION DELIVERY CONTROL SYSTEMS AND METHODS

BACKGROUND

Embodiments of the invention generally relate to medication delivery systems and methods thereof. In particular, a system and related methods of securely dispensing medication to a patient are disclosed.

Ensuring the accurate and secure delivery of medication to a patient is of fundamental concern to health care providers. This is particularly true in medical facilities such as hospitals, where large quantities of different medications are delivered, generally by hand, to patients at their bedsides who may be unable to verify that they are receiving the correct medication as prescribed by their respective doctors.

Probably the oldest and most common drug delivery verification system simply comprises visual verification by the health care provider that the label on the medication matches the identification of the patient. More recently, however, electronic solutions have been employed, which comprise the scanning of barcodes on the patent's ID and on the medication to obtain delivery confirmation via a patient database.

Electronic tracking helps prevent the inadvertent delivery to one patient of medication prescribed to another patient, which may occur, for example, due to medical staff fatigue or the careless handling of medications. However, such systems are effective only to the extent that they are correctly used by hospital personnel. Overworked and harried staff may elect, from time to time, not to perform the rather tedious scanning procedures. Moreover, staff may sometimes deliberately provide to one patient medication that is available but prescribed to another patient. It would be desirable to provide systems and methods that would prevent misdelivery of medication, unless misdelivery is absolutely required.

Therefore, new medication delivery control systems and methods that stringently control the distribution of medications are desired.

SUMMARY

A first aspect of the invention pertains to a medication control system. In one or more embodiments, the system comprises a plurality of keys, each key associable with a patient; and a plurality of locking caps configured to be locked to medication containers to restrict access to medication contained therein, each locking cap adapted to be unlocked by at least one of the keys. Each of these keys is unique and may be assigned to, and thereby associated with, a patient. That is, the keys may be distributed to the patients, for example, by attaching the key of each patient to that patient's identification band. In certain embodiments, the medication delivery system further comprises a plurality of locking caps that are capable of locking onto medication containers to restrict access to medication contained within the medication containers. Each locking cap may be unlocked by one of the unique keys.

In one embodiment, the medication delivery system further comprises a plurality of unique identifiers that are respectively associated with the unique keys, a plurality of template caps and a cap encoder. The cap encoder accepts a template cap and one of the unique identifiers and encodes the template cap to create the locking cap that is capable of being unlocked by the unique key associated with the unique identifier. In a specific embodiment, the unique keys each comprise a unique pattern of protrusions, and the cap encoder modifies a template cap so as to have a plurality of depressions that correspond to the protrusions of the key for which the template cap is being encoded.

In another embodiment the medication delivery system further comprises a master key capable of unlocking every locking cap. The master key may have a counter that counts the number of times that the master key has been used to unlock a locking cap. The counter may be designed so that it cannot be reset. Each locking cap may therefore be unlocked only by its corresponding key and the master key.

Another aspect of the invention pertains to a method of delivering medication to a patient. In one embodiment the method comprises associating a key with the patient. In certain embodiments, this association may be performed, for example, by affixing the key to the identification band that is typically provided to patients upon their admittance to a hospital. A container is provided, into which medication for the patient is placed. This container may be a medicine bottle, an IV bottle or bag, a syringe, or other standard medication container, or may be a container into which a standard medication container may be placed. The container is lockable with a lock adapted to restrict access to the container. The lock may be, for example, a locking top for a medicine bottle. In certain embodiments, the cap could be adapted to fit standardized medicine containers, and in other embodiments, a plurality of differently sized caps could be provided to fit standardized medicine containers. The lock may be unlocked with the key. The container is locked with the lock to restrict access to the medication in the container. Once the container is delivered to the patient, the key may be utilized to unlock the lock and thereby accessing the medication. The medication may then be removed or dispensed from the unlocked container and provided to the patient.

In one embodiment the lock is a disposable item that is crafted in an on-demand fashion so that it can be unlocked with the key placed in proximity to or affixed to the patient. An identifier may be associated with the key. This identifier may be, for example, the ID number used to identify the patient, or may be an ID number unique to the key. The lock is then fashioned according to this identifier so that the lock may be unlocked by the key. In one embodiment, substantially identical template locks may be provided, which are capable of locking suitably configured medication containers. The template locks may be modified so that they can be unlocked only by a specific patient key, and optionally by one or more master keys. The template locks may come in a plurality of sizes that correspond to the various sizes of medication containers. In a particular embodiment, tailoring the template locks to a particular key comprises forming depressions in the lock that correspond to protrusions on the key.

DETAILED DESCRIPTION

Before describing several exemplary embodiments of the invention, it is to be understood that the invention is not limited to the details of construction or process steps set forth in the following description and drawings. The invention is capable of other embodiments and of being practiced or carried out in various ways. Additionally, in the following, items which are substantially the same across the various embodiments are given the same reference numbers.

Figure 1:
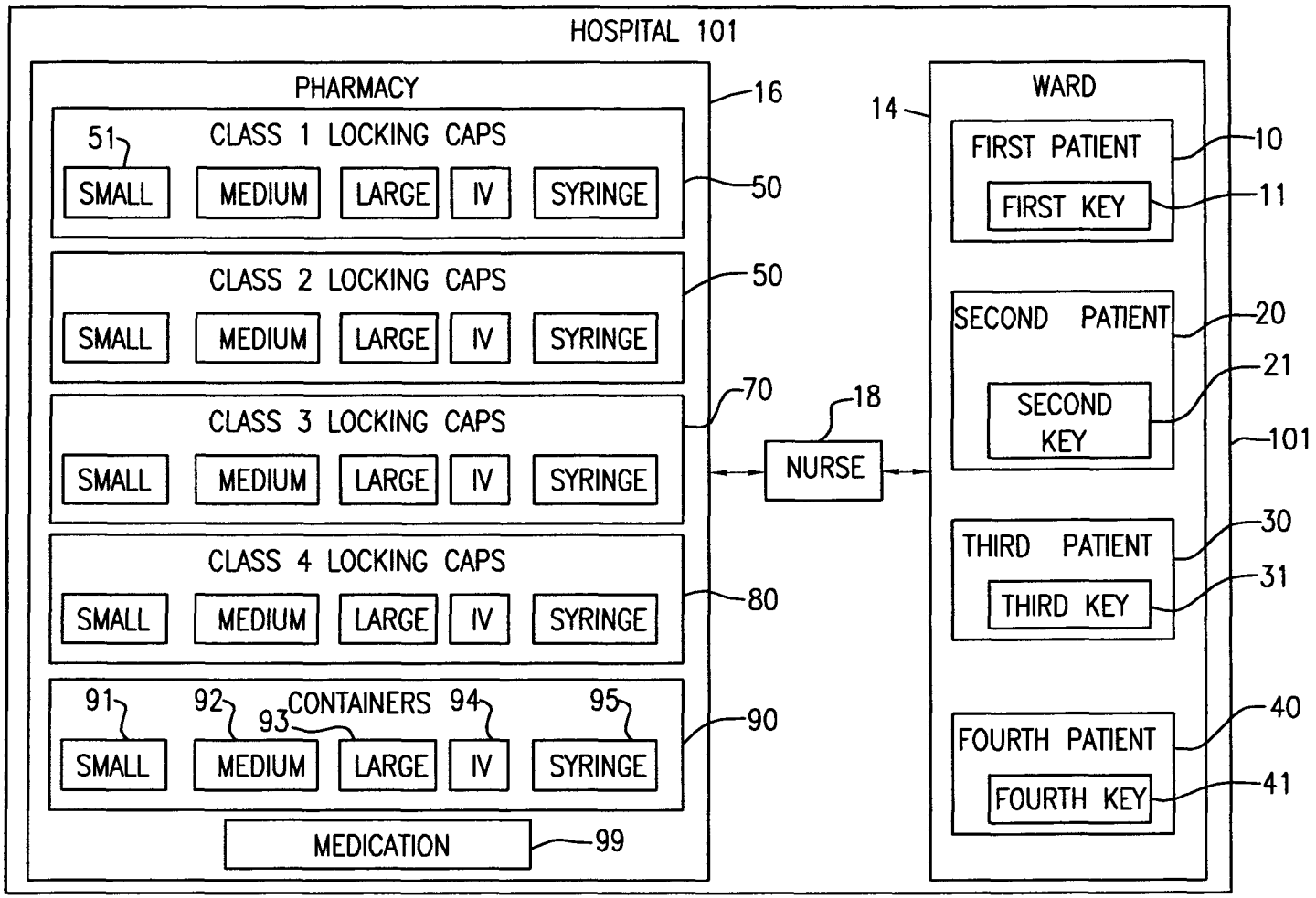
FIG. 1 is a block diagram illustrating a drug delivery system and a related method in a hospital according to a first embodiment.

FIG. 1 is a block diagram illustrating a first embodiment drug delivery system and related method in a hospital setting 101. It will be understood that the present invention is not limited to use in any particular setting, however, embodiments of the invention are particularly useful in medical facilities such as hospitals and long term care facilities such as nursing homes. Embodiments of the invention may be used in prisons where medication tampering can be a dangerous problem for inmates, and in other embodiments, the system can be used in a home setting to prevent access to medications where a child is old enough to defeat the child proof lid. For ease of description, the use in hospital 101 has been greatly simplified, and it will be appreciated that a larger number of patients and other elements depicted would be present in an actual hospital. The hospital 101 includes a ward 14, a pharmacy 16 and a nurse 18. The ward 14 holds a first patient 10, a second patient 20, a third patient 30 and a fourth patient 40. The pharmacy 16 contains medication 99, which is eventually dispensed to the patients 10, 20, 30, 40 through the nurse 18.

Each patient 10, 20, 30, 40 is provided a respective key 11, 21, 31, 41 that is unique to that patient 10, 20, 30, 40. Specifically, the first patient 10 is provided a first key 11; the second patient 20 is provided a second key 21; the third patient 30 is provided a third key 31, and the fourth patient 40 is provided a fourth key 41. The keys 11, 21, 31, 41 may be attached, for example, to the respective wrists or identification bracelets of the patients 10, 20, 30, 40, and may be provided to the patient 10, 20, 30, 40 with the identification bracelet. It may be desirable, therefore, that they keys 11, 21, 31, 41 be smooth, and without any sharp edges or points to avoid harming the patients 10, 20, 30, 40. Alternatively, the keys could be fixed to an object in the patient's room, such as to the bed, geriatric chair, nightstand or other piece of furniture in the patient room. However, in a preferred embodiment, the key is physically associated with or affixed to the patient.

To deliver the medication 99 to the intended recipient patient 10, 20, 30, 40, the medication 99 must be placed into a suitable container 90. For example, pills may be placed into pill bottles, which may be small bottles 91, medium bottles 92 or large bottles 93. Intravenous medication may be delivered in IV bottles or bags 94; other types of medication may be delivered in hypodermic syringes 95.

For each type of container 90, the pharmacy 16 has a suitably adapted locking cap. Each locking cap is adapted to lock onto its corresponding container 90 so as to lock the medication 99 inside the container 90 and thus restrict access to the medication 99. The locking caps are divided into four classes, each class of which can only be opened by a corresponding key 11, 21, 31, 41. Specifically, class one locking caps 50 can only be unlocked by the first key 11; class two locking caps 60 can only be unlocked by the second key 21; class three locking caps 70 can only be unlocked by the third key 31, and class four locking caps 80 can only be unlocked by the fourth key 41. In certain embodiments, each group of caps can be provided in different sizes that are adapted to lock differently sized medicine containers, for example, standardized medicine containers dispensed by pharmacies.

The first embodiment medication delivery system comprises the keys 11, 21, 31, 41 and the locking caps 50, 60, 70, 80, and is utilized as explained in the following by way of example with the first patient 10. First, a doctor determines that a specific type and dosage of medication 99 is required to be administered to the first patient 10. A prescription for this medication 99 is sent to the pharmacy 16, which then works to fill the order. In particular, a suitable container 90 is selected to hold the medication 99 destined for the first patient 10. For example, a relatively small dosage of antibiotic pills may be prescribed. The pharmacy 16 may thus select a small container 91 into which the antibiotic pills are placed. The pharmacy 16 is provided with the information that the first patient 10 has the first key 11; that is, that the prescription is being filled for a patient that is associated with the first key 11. Consequently, when selecting a suitable locking cap for the small container 91, the pharmacy 16 only utilizes class one locking caps 50. For the small pill container 91 destined for the first patient 10 (and hence to be unlocked by first key 11), the pharmacy 16 selects a small, class one locking cap 51, which matches the dimensions and type of the small container 91. The locking cap 51 is then locked onto the container 91 to lock the medication 99 within the container 91. Thereafter, the container 91 can only be unlocked by the first key 11 or a master key, which will be described further below. Access to the medication 99 within the locked container 91 is thereby restricted.

The pharmacy 16 provides the now-locked container 91 to the nurse 18, who then physically brings the locked container 91 to the first patient 10. Either the nurse 18 or the first patient 10 may use the first key 11 to unlock the locking cap 51 from the container 91. Once the container 91 is unlocked, the medication 99 within the container 91 may be accessed and administered to the first patient 10. Neither the second, third, nor fourth keys 21, 31, 41 will provide access to a container 90 that has been locked with the class one locking cap 50. Hence, medication 99 destined for the first patient 10 must be physically delivered to the proximity of the first patient 10 so as to be able to utilize the first key 11 and thereby gain access to the contents within the container 90. The proximity of the first patient 10 may include, for example, the bedside of the first patient 10, the room of the first patient 10 or the wing or ward in which the first patient 10 is present. The proximity of the first key 11 is ideally the same as the proximity of the first patent 10 so that physical delivery of the medication 99 within a suitably locked container 90 to the proximity of the patient 10 is required.

In a similar vein, medication 99 destined for the second, third or fourth patients 20, 30, 40, and consequently respectively locked within a container 90 with a class two 60, class three 70 or class four 80 locking cap, must be physically delivered to the proximity of the target patient 20, 30, 40 to use the respective key 21, 31, 41 to unlock the container 90. Once unlocked from the container 90, the locking cap 50, 60, 70, 80 may be reused or discarded, depending upon the implementation used for the locking caps 50, 60, 70, 80.

Figure 2:
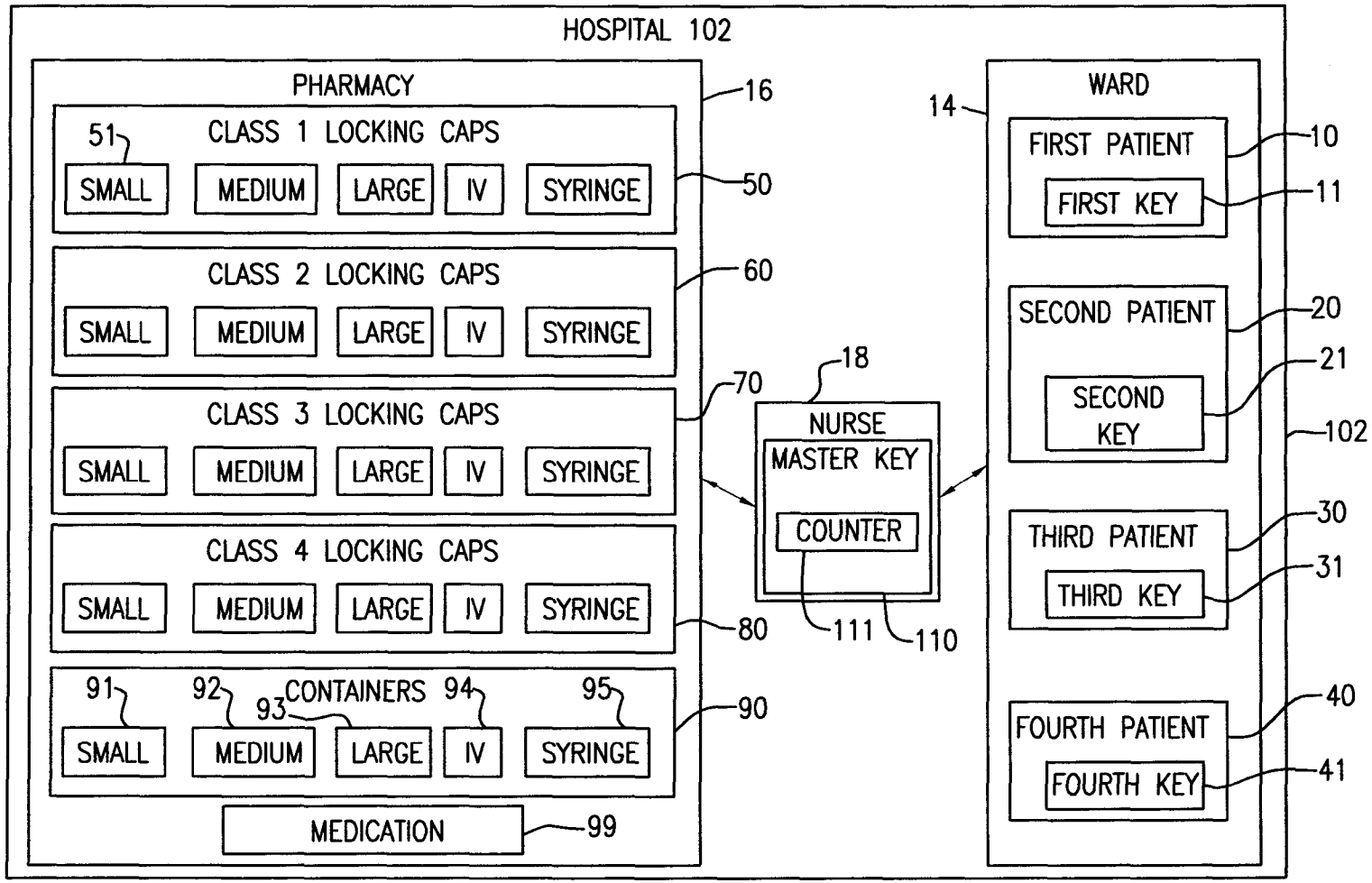
FIG. 2 is a block diagram illustrating a second embodiment of a drug delivery system and related method in a hospital.

In the first embodiment, only the patient keys 11, 21, 31, 41 may be used to unlock the locking caps 50, 60, 70, 80 from a locked container 90. Such restrictive access, however, may prove inconvenient or even dangerous if a key 11, 21, 31, 41 is unavailable for a variety of reasons. For example, if the locked container 91 of the above example is brought to the first patient 10 and the first patient 10 has lost or discarded the key 11, or the key cannot be accessed on an aggressive or uncontrollable patient, then neither the patient 10 nor the nurse 18 will be able to access the medication 99. Alternatively, in medical emergencies, the keys 11, 21, 31, 41 may not be readily at hand when time is at a premium. As a result, for a second embodiment hospital 102 as shown in FIG. 2, it may be advisable to provide a master key 110. The master key 110 may be given to any suitable member of the hospital staff, such as the nurse 18, and is capable of unlocking all classes of locking cap 50, 60, 70, 80. Hence, class one locking caps 50 may be unlocked only by the master key 110 and the first key 11, class two locking caps 60 may be unlocked only by the master key 110 and the second key 21, etc.

To avoid abuses of the master key 110, such as the use of the master key 110 to open locked containers 90 when no medical emergency or similar condition is present, the master key 110 may be provided a counter 111 that counts the number of times that the master key 111 is used. The counter 111 may be of a type that cannot be reset by the normal user of the master key 110, such as the nurse 18; that is, the value presented by the counter 111 cannot be wound back to an earlier value, nor set to a default value (such as zero), but instead only increases with each use of the master key 110. When distributed by supervisory staff, the value of the counter 111 may be recorded. Any subsequent changes in the value of the counter 111 may be questioned, and should correspond to a related medical emergency, a lost key 11, 21, 31, or 41, or other similarly pressing need for use of the master key 110. Usage of similar medications 99 for different patients simply because they are conveniently located or available may thereby be discouraged, and patient medication regimens are consequently better protected.

Figure 3A:
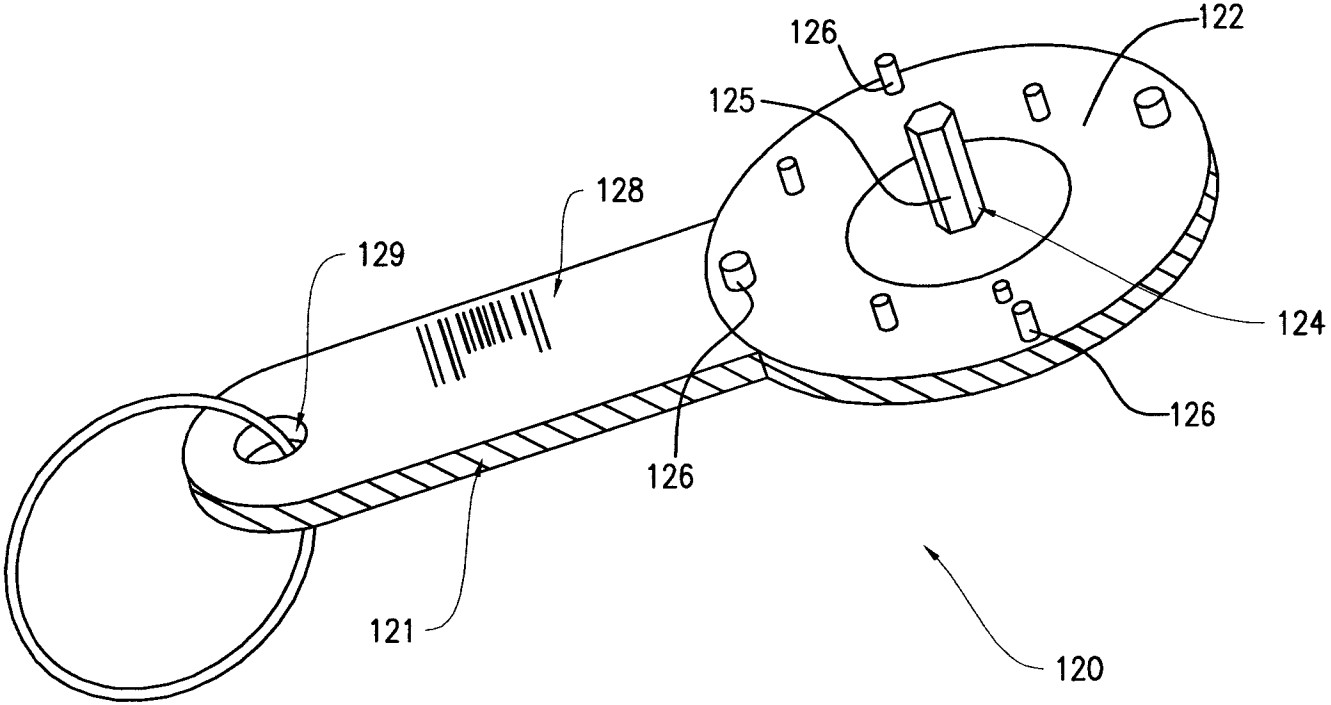
FIG. 3A is a perspective view of a patient key according to one embodiment.

FIG. 3A is a perspective view of an example first embodiment patient key 120. The patient key 120 comprises a base plane 122. Extending from a central region of the base plane 122 is a stem 124. The stem 124 has at least one face 125 so that it can impart torque to a counter-part slot in a lock. The cross-sectional shape of the stem 124 may be, for example, hexagonal, rectangular, star-shaped, etc., with respect to the base plane 122. Surrounding the stem 124 and also extending from the base plane 122 are a plurality of protrusions 126. The number of protrusions 126 may vary among different keys 120, as may the radial distance of each protrusion 126 from the stem 124, the respective diameters of each protrusion 126, the relative lengths of the protrusions 126, and the angular distribution of the protrusions 126 around the stem 124 The pattern of protrusions 126 is preferably unique among each of the different keys. The key 120 has a handle 121 that is used to turn the key 120 to impart torque to the stem 124. Additionally, the key 120 may have a bar code 128 that encodes an identity number of the key 120. The identity number of the key 120 is preferably unique to each unique key 120. Alternatively, an RFID chip, plain text or other suitable encoding method may be used instead of the bar code 128 to encode the identity number onto the key 120. The key 120 may also have a hole 129, or equivalent fastener or attaching device (such as a ring), in the handle 121 for attaching the key 120 to the ID bracelet of the patient to whom the key 120 is provided, or to furniture near the patient.

Figure 4A:
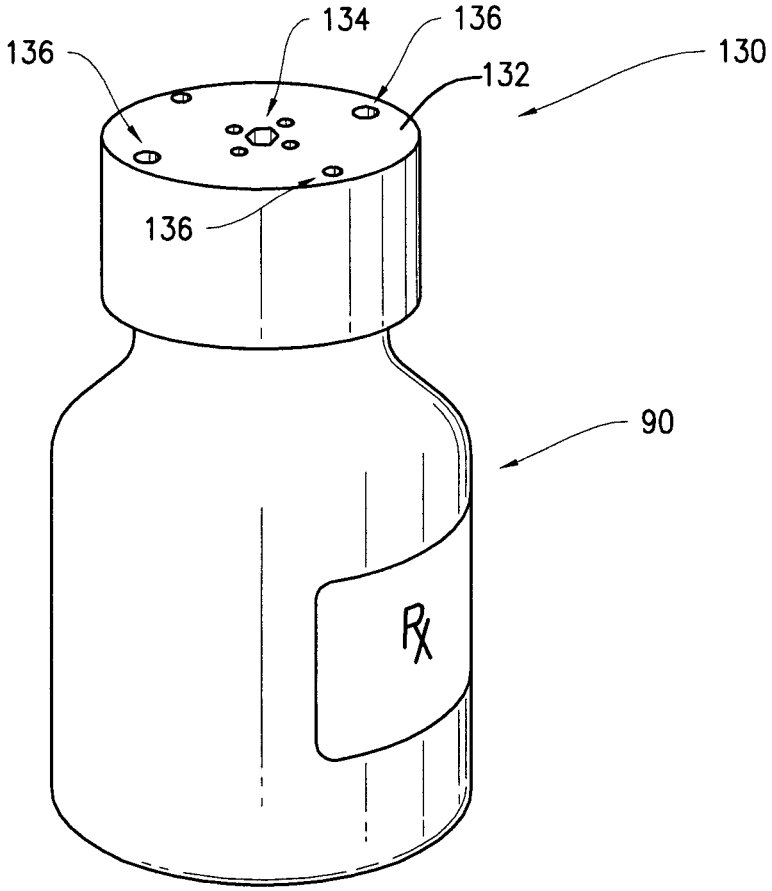
FIG. 4A is a perspective view of a locking top locked onto a medication container according to one embodiment.
Figure 4B:
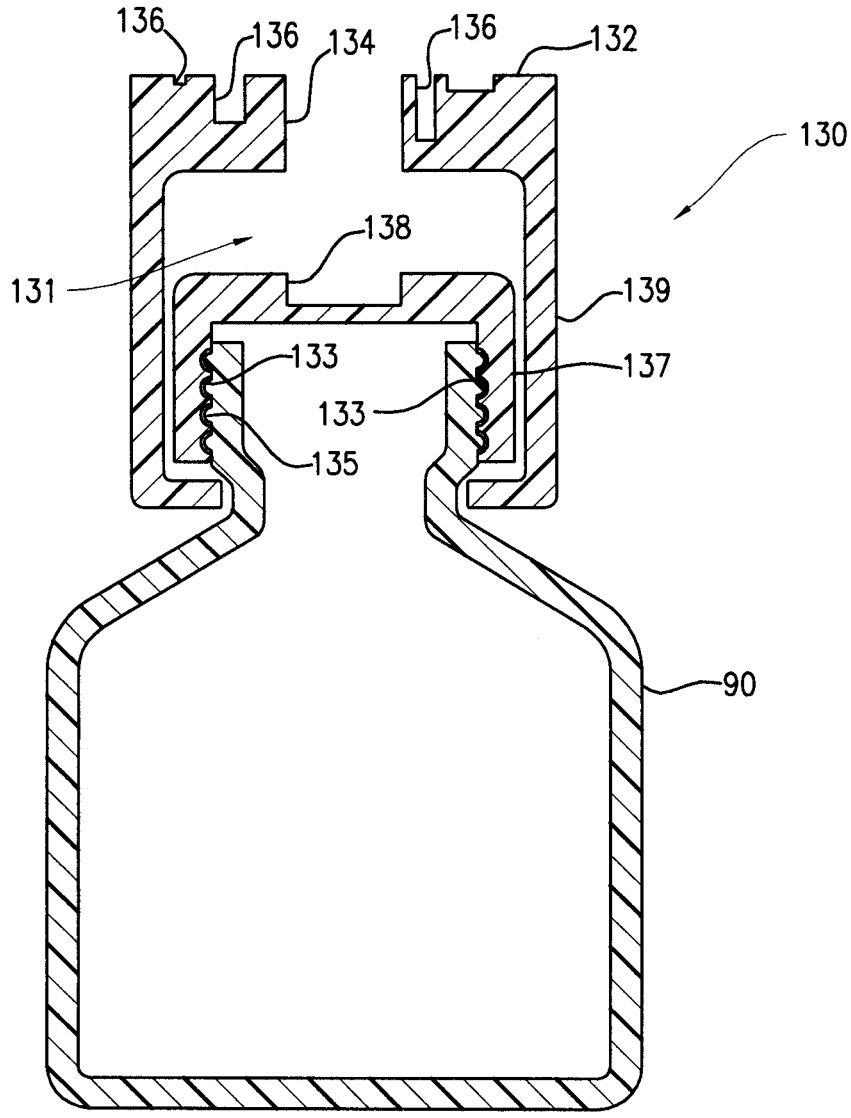
FIG. 4B is a cross-sectional view of the locking top and medication container of FIG. 4A.

FIGS. 4A and 4B respectively show perspective and cross-sectional views of an example first embodiment locking cap 130, and the mechanical interaction of the example key 120 with the example locking cap 130 to unlock a container 90. A top surface 132 of the locking cap 130 is flat, and corresponds to the base plane 122 of the key 120. A hole 134 in the top surface 132 corresponds to the position of the stem 124. Disposed across the top surface 132 are depressions 136, the positions, sizes and depths of which correspond to the positions, sizes and lengths of the protrusions 126. Hence, when the pattern of depressions 136 corresponds to the pattern of protrusions 126, the base plane 122 of the key 120 may lay flush against the top surface 132 of the locking cap 130. As a result, the stem 124 may maximally extend through the hole 134 to reach into the internal space 131 of the locking cap 130. The stem 124 has a length that is just long enough to engage a slot 138 within the internal space 131 of the locking cap 130. The slot 138 may have a cross-sectional shape that corresponds to the cross-sectional shape of the stem 124. When the handle 121 is then turned, torque imparted to the stem 124 is further imparted to the slot 138 through the at least one face 125 of the stem 124.

The top surface 130 is simply the top portion of an outer cap 139, which surrounds an inner cap 137. The inner cap 137 locks onto the container 90 to restrict access to the contents of the container 90. When a torque is applied to the inner cap 137, the inner cap 137 twists free of the container 90, so that the entire locking cap 130 may be removed form the container 90. The inner cap 137 may, for example, have threads 133 to screw onto the container 90 having complementary threads 135, or may have breakable tabs that engage with the container 90 as described further with respect to FIG. 4C. The outer cap 139 rotates freely around the inner cap 137. As a result, attempts to unscrew the locking cap 130 from the container 90 will be unsuccessful, as this will simply result in the outer cap 139 rotating freely around the inner cap 137 without imparting any substantial torque onto the inner cap 137. Moreover, as the outer cap 139 completely covers the inner cap 137 but for the hole 134, a user cannot turn the inner cap 137 without a suitably designed key 120.

Figure 4C:
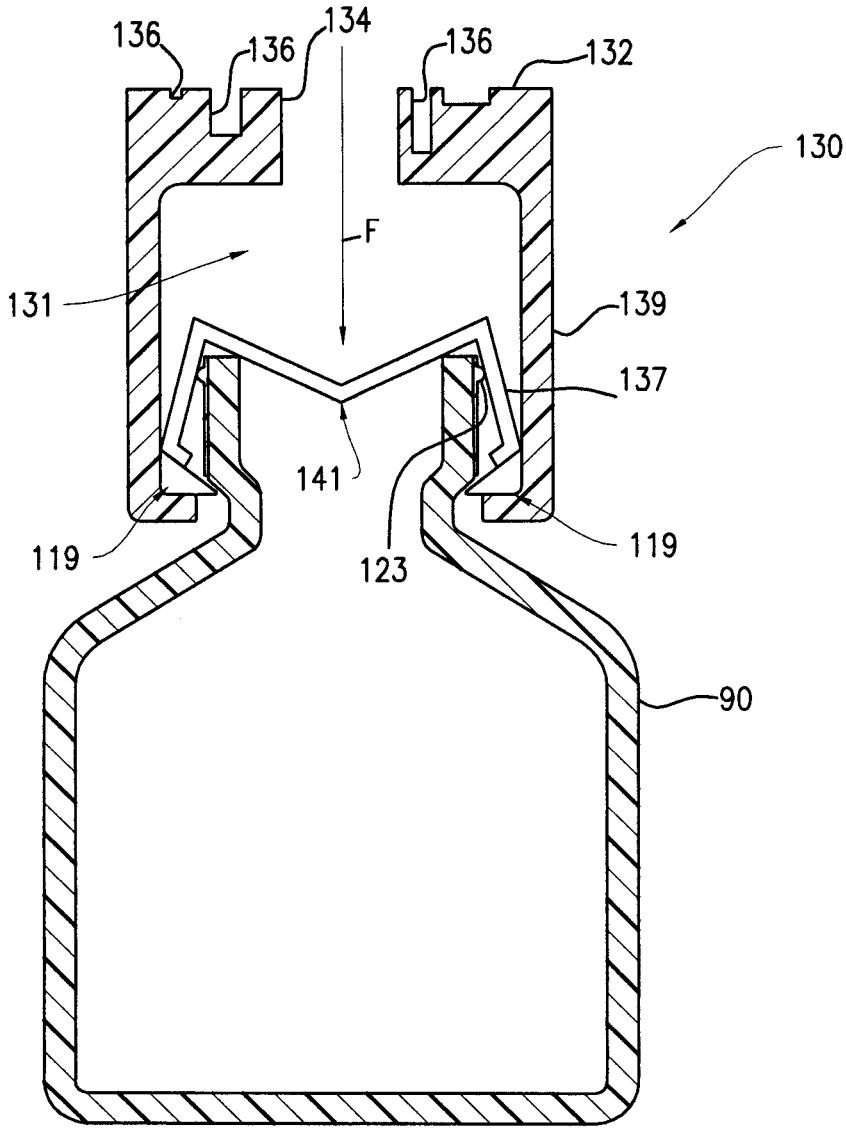
FIG. 4C is a cross-sectional view of an alternative embodiment of the locking top and medicine container.

FIG. 4C shows an alternative embodiment of a locking cap and medicine container 90. The embodiment shown in FIG. 4C is similar to the embodiment shown in FIGS. 4A and 4B, however, slot 138 has been eliminated from the locking cap. In the embodiment in FIG. 4C, stem 124 of the key is designed to be long enough to reach inner cap 137 and apply a force represented by arrow F. In this embodiment, the threads 133 and 135 in FIG. 4B can be eliminated and a ridge 123 can be provided around the container to cooperate with cap to secure the locking cap to the container 90 in a snap fit relationship. The force F applied by stem 124 causes inner cap 137 to flex away from the neck of container 90 so that pulling the locking cap 130 away from the container releases the inner cap 137 from the container 90. According to this embodiment, the locking cap can be more quickly applied to and removed from the container 90. In this embodiment, outer cap 139 may include a wedged surface 119 to prevent removal of locking cap 130 without unlocking the inner cap. If removal of locking cap 130 is attempted without unlocking the inner cap 137, wedged surface 119 applies compressive force to the inner cap 137 against the container 90. Similarly the outer cap 139 and inner cap 137 caps will rotate freely relative to each other unless the cap key is engaged.

The inner cap 137 is connected to the slot 138. Hence, any torque applied to the slot 138 is mechanically applied to those portions of the inner cap 137 that engage with the container 90, such as the threads 133. When a matching key 120 is placed against a corresponding locking cap 130, the base plane 122 will lie flush against the top surface 132 so that the stem 124 may fully extend into the slot 138. When the key 120 is turned, the mechanical interaction of the stem 124 with the slot 138 causes the inner cap 137 to turn, thus unlocking the locking cap 130. If, however, the pattern of protrusions 126 on the key 120 does not match the pattern of depressions 136 on the lock 130, the base plane 122 will not lie flush against the top surface 132, and the stem 124 will be unable to extend into the slot 138; hence the key 120 will be unable to impart torque to the inner cap 137, and therefore unable to unlock the locking cap 130 from the container 90.

It may be desirable to design unique corresponding patterns of protrusions 126 and depressions 136, so that each key is unique to every other key. It may also be desirable to provide at least two protrusions 126 that are unique to each key. Protrusions 126 that are unique to a key may be equally spaced around the stem 124. Such an arrangement may help to insure that the stem 124 is provided a maximum standoff distance from the slot 138 for mismatched key/lock pairs.

Figure 3B:
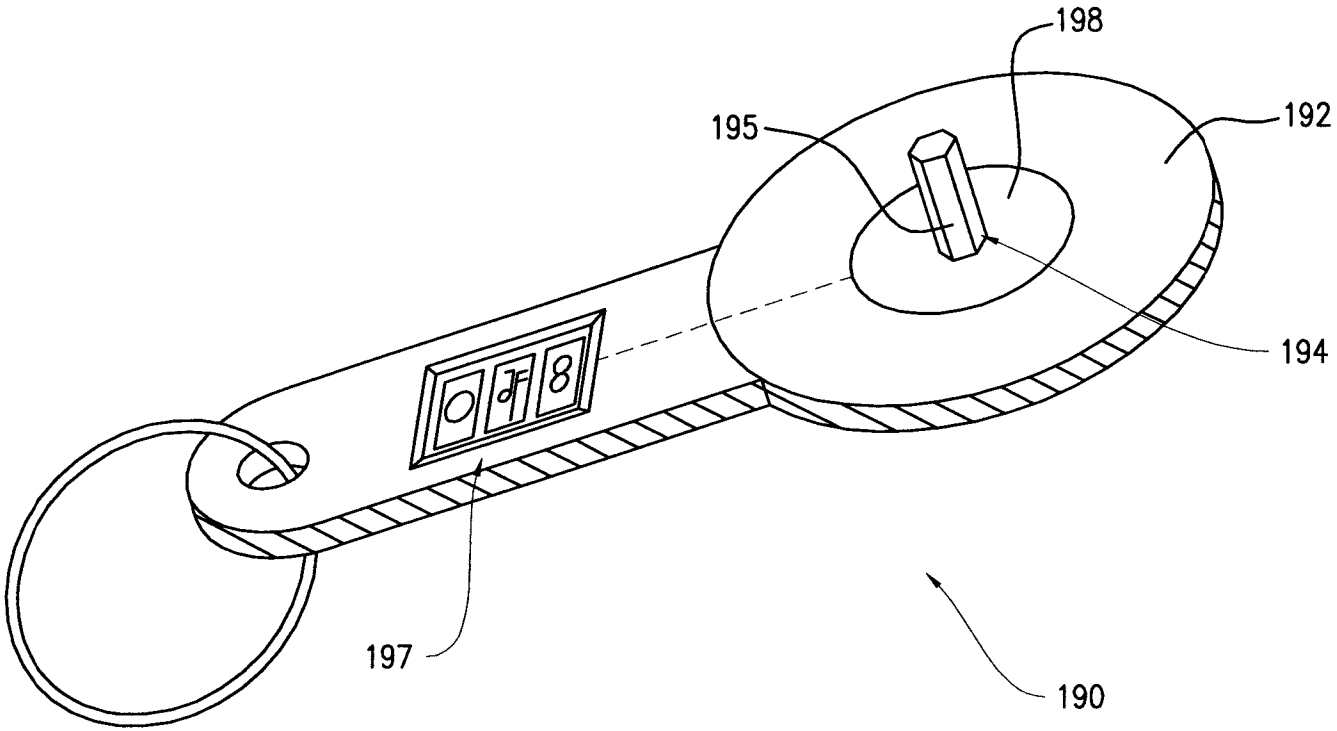
FIG. 3B is a perspective view of a master key according to one embodiment.

FIG. 3B is a perspective view of an example first embodiment master key 190. The master key 190 may include a base plane 192. Extending from a ratchet region 198 of the base plane 192 is a stem 194. Like the patient key 120, the stem 194 has at least one face 195 so that can impart torque to the counter-part slot 138 in the lock 130. The cross-sectional shape of the stem 194 may be, for example, hexagonal, rectangular, start-shaped, etc., with respect to the base plane 192. The base plane 192 may be devoid of protrusions, and hence is capable of laying flush against any lock 130. As a result, the stem 194 can engage with the slot 138 of any lock 130. The ratchet region 198 is connected to a counter 197. When the torque required to unlock a lock 130 is imparted onto the step 194, the ratchet region 198 activates the counter 197, causing the counter 197 to increment. As a result, each time the master key 190 is used, the value displayed by the counter 197 increases.

Although the master key 190 is shown without protrusions, it may be possible to provide master keys with protrusions. In this case, different classes of master keys may be provided, corresponding to the different patterns of protrusions given to each master key. Each master key can then unlock only those classes of locks that have patterns of depressions 136 that correspond to the protrusions of that class of master key.

Other embodiments for locking tops and corresponding keys are certainly possible. For example, the key may comprise an RFID chip embedded within the ID bracelet of the patient, and encoded with a unique value associated with that patient. The locking top could then include an RFID reader, and an electromechanical lock that is capable of engaging and disengaging from a container 90 in response to a signal provided by the RFID reader. The RFID reader could be provided the unique value associated with a patient, and would activate the electromechanical lock to disengage from the container 90 when an RFID chip encoded with the unique value is read, or when a master code is read. A battery may be provided in such a locking cap to provide electrical power to the RFID reader and the electromechanical lock. Alternatively, a magnetic key and magnetic key reader, or a bar code and bar code reader, may respectively be swapped in place of the RFID chip and RFID reader.

Figure 5:
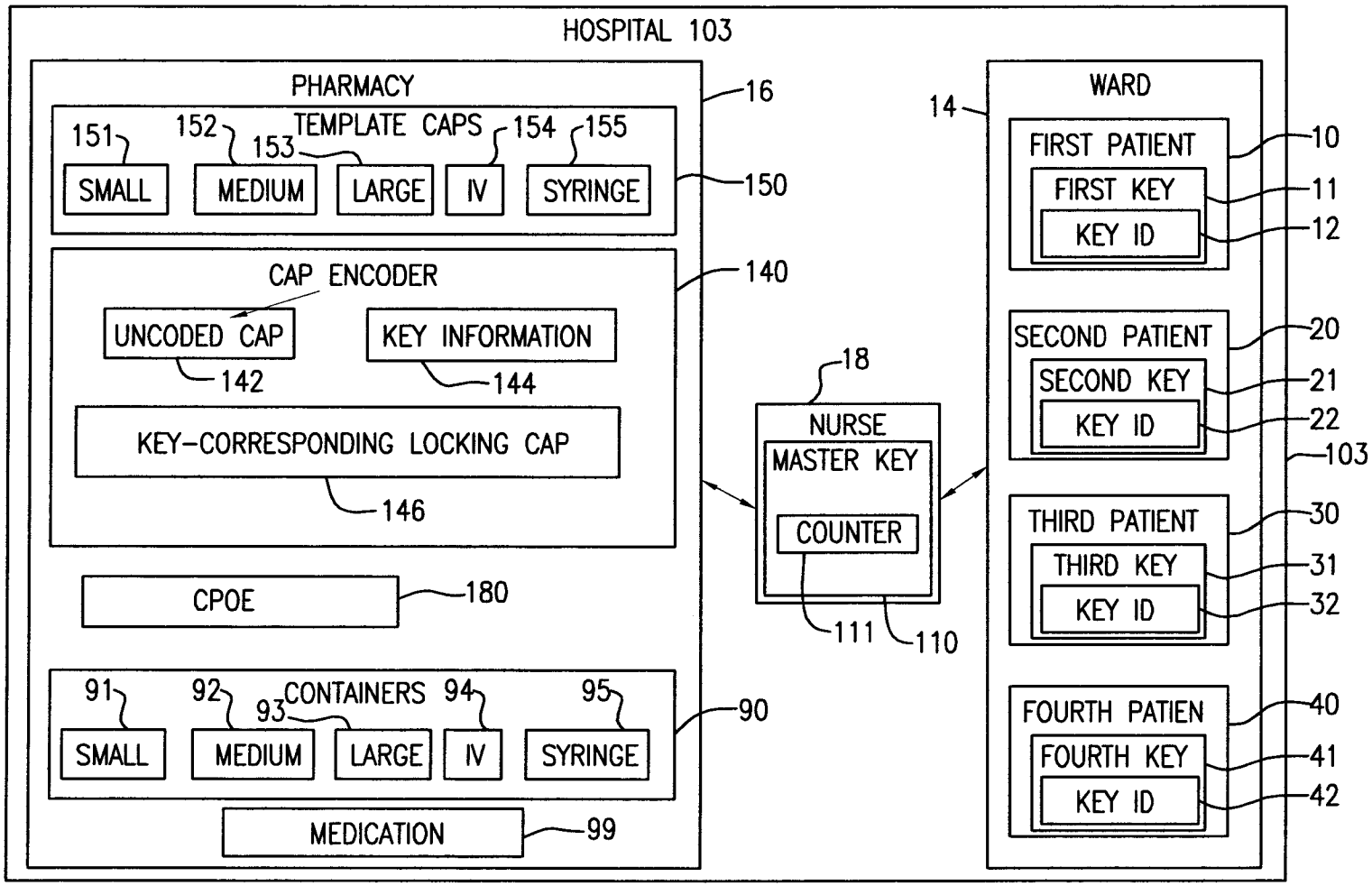
FIG. 5 is a block diagram illustrating a use of a drug delivery system and related method according to a third embodiment in a hospital.

A third embodiment method and related system is indicated in FIG. 5. Rather than including a plurality of pre-made locking caps that are each tailored to a specific key, a hospital 103 may instead have a plurality of template caps 150 and a cap encoder 140. The template caps 150 and cap encoder 140 may be placed, for example, in the pharmacy 16, although this certainly is not required. Utilizing the template caps 150 and the cap encoder 140, the hospital 103 is capable of producing locking caps on demand for any type of key 11, 21, 31, 41 and container type 91-95.

The template caps 150 come in various types 151-155 to respectively lock or restrict access to the various container types 91-95. The template caps 150 are generic in class in that they are not encoded for any particular key 11, 21, 31, 41. Depending upon the particular situation, this may mean that no patient key 11, 21, 31, 41 may unlock a container 90 locked with a template cap 150. For example, with specific reference to FIGS. 4A and 4B, a generic template cap 150 may have no depressions 136 so that the top surface 132 is completely smooth, or has only a few, pre-defined depressions 136. Similarly, for caps that employ RFID readers, the RFID reader may have no patient-specific identification number, and for caps that employ magnetic keys the magnetic key reader may have no information describing the encoding of the patient-specific magnetic key.

The cap encoder 140 transforms a template cap 150 into a cap that may be unlocked by a specific patient key 11, 21, 31, 41. That is, the cap encoder 140 modifies a template cap 150 for unlocking association with a patient key 11, 21, 31, 41. The cap encoder 140 accepts a template cap 150 as an uncoded cap 142. The cap encoder 140 also accepts as input key information 144. The key information 144 contains the information required to transform the uncoded cap 142 into a key-corresponding locking cap 146 that may be unlocked by one of the patient keys 11, 21, 31, 41 and, optionally, the master key 110. For example, with specific reference to the key 120 of FIG. 3, key information 144 may include, for example, the size and location of every protrusion 126. With further reference to FIGS. 4A-4B, the cap encoder 140 utilizes the key information 144 to create a corresponding pattern of depressions 136 in the uncoded cap 142, thereby creating a locking cap 146 that corresponds to one of keys 11, 21, 31, 41 whose key information 144 was provided. The depressions 136 may be formed, for example, by ultrasonic welding, heat, drilling, or any other suitable method known in the art of computer aided manufacturing (CAM). For embodiments that employ RFID chips, the key information 144 may include the RFID number associated with a particular patient 10, 20, 30, 40, and the cap encoder 140 may program the RFID reader to unlock the uncoded cap 142 when the RFID reader detects an RFID chip having the key information 144. Similarly, for embodiments that employ magnetic keys, the key information 144 may include the magnetic patterns of the magnetic key associated with a particular patient 10, 20, 30, 40, and the cap encoder 140 may program the magnetic key reader to unlock the uncoded cap 142 when the magnetic key reader detects a magnetic key encoded with the key information 144.

The cap encoder 140 may be, for example, a microwave-sized device into which may be placed a container 90 filled with medication 99. In certain embodiments, the cap encoder can be in communication with medication handling machines such as pill sorters and dispensers so that as the drugs pass through these machines, the capping system waiting at the end can encode and apply the cap automatically without any human intervention. The cap encoder 140 may automatically select an appropriate type 151-155 of template cap 150, for example by scanning the container 90 or through simple registration by which container 90 is selected for filling, or may be programmed by a user to select the uncoded cap 142 type 151-155. Alternatively, the container 90 may be placed inside the cap encoder 140 with the uncoded cap 142 already locked onto to the container 90.

Figure 6:
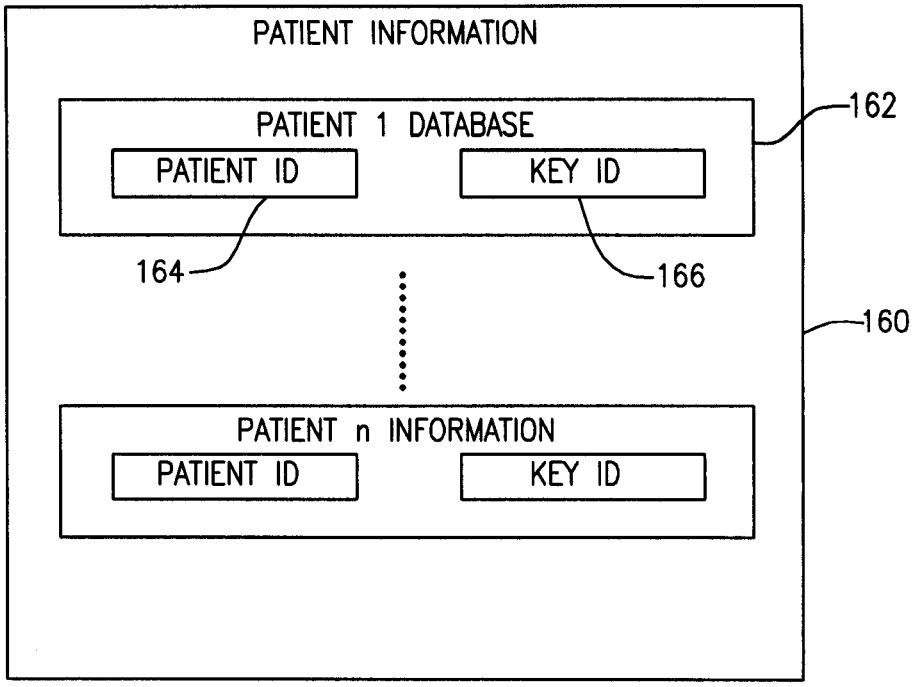
FIG. 6 illustrates an embodiment of a patient database.

Various methods may be employed to provide the key information 144 to the cap encoder 140. One example is provided with reference to FIGS. 5-7. The hospital 103 will typically include a computerized physician order entry system (CPOE) 180 which enables physicians to electronically place orders with the pharmacy 16, as well as keep track of patient-related information (such as drugs prescribed, patient status, location, etc.), as is known in the art. In particular, the CPOE 180 may contain a patient database 160, which holds patient-related information. The patient database 160 may hold respective entries 162 for each patient 10, 20, 30, 40. Amongst a great deal of other information, each patient entry 162 may contain a patient ID value 164 and a key ID value 166. Each key 11, 21, 31, 41 may respectively be provided a unique ID value 12, 22, 32, 42, and this ID value 12, 22, 32, 42 is recorded into the key ID field 166 for that patient 10, 20, 30, 40. Either the CPOE 180 or the cap encoder 140 may further comprise a key database 170. The key database 170 includes respective key information entries 172 for each key 11, 21, 31, 41. Each key information entry 172 includes the key ID 174 for that key 11, 21, 31, 41 and corresponding key information 176 that may be needed to encode a corresponding locking cap for that key 11, 21, 31, 41.

When a physician utilizes the CPOE 180 to place an order for medication 99, the pharmacy 16 utilizes the patient ID number provided by the physician to index into the patient database 160, utilizing the patient ID fields 164, to obtain the key ID 166 for the key 11, 21, 31, 41 issued to that patient 11, 21, 31, 41. The key ID 166 may then be used to index into the key database 170, utilizing the key ID fields 174, to obtain the key information 176 for that key 11, 21, 31, 41. This key information 176 is then provided as the key information 144 when the cap encoder 140 encodes the uncoded cap 142.

Figure 7:
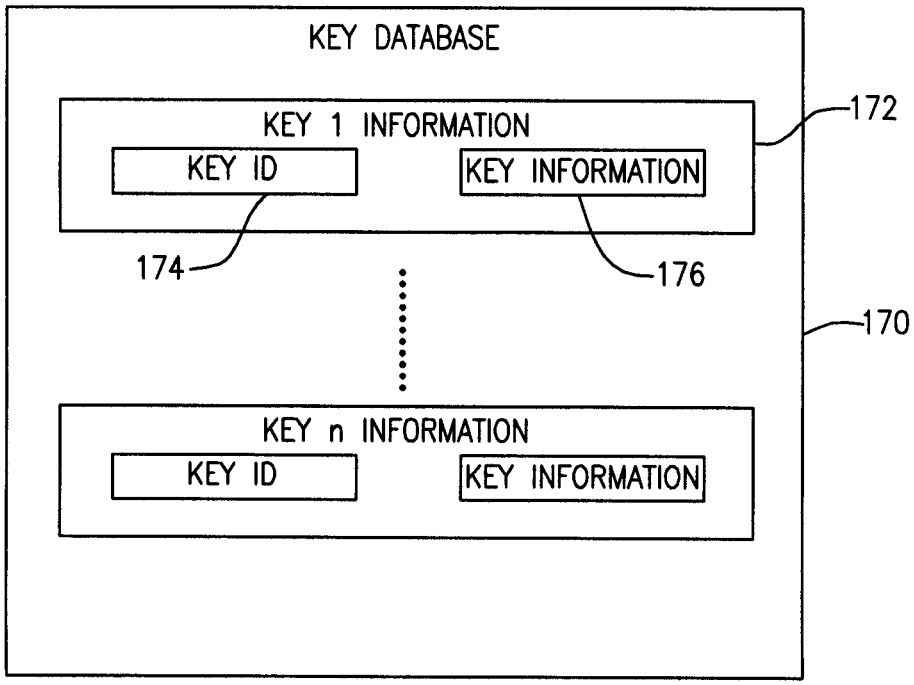
FIG. 7 illustrates an embodiment of a key database.

Referring now to FIG. 7, the benefit of associating with each key 11, 21, 31, 41 a respective key ID 174 and related key information 176 is seen as providing programmable flexibility between key IDs 174 and the related key information 176. However, it should be noted that, given the inherently unique configuration of each unique key 11, 21, 31, 41, and hence the correspondingly unique data for each respective key information field 176, the key information 176 may actually also serve as the key ID 174. If such an arrangement is used for the CPOE 180 or cap encoder 140, then the key ID 166 associated with each patient entry 162 would be used as the key information 144 for the cap encoder 140, and the key database 170 would not be required.

Figure 8:
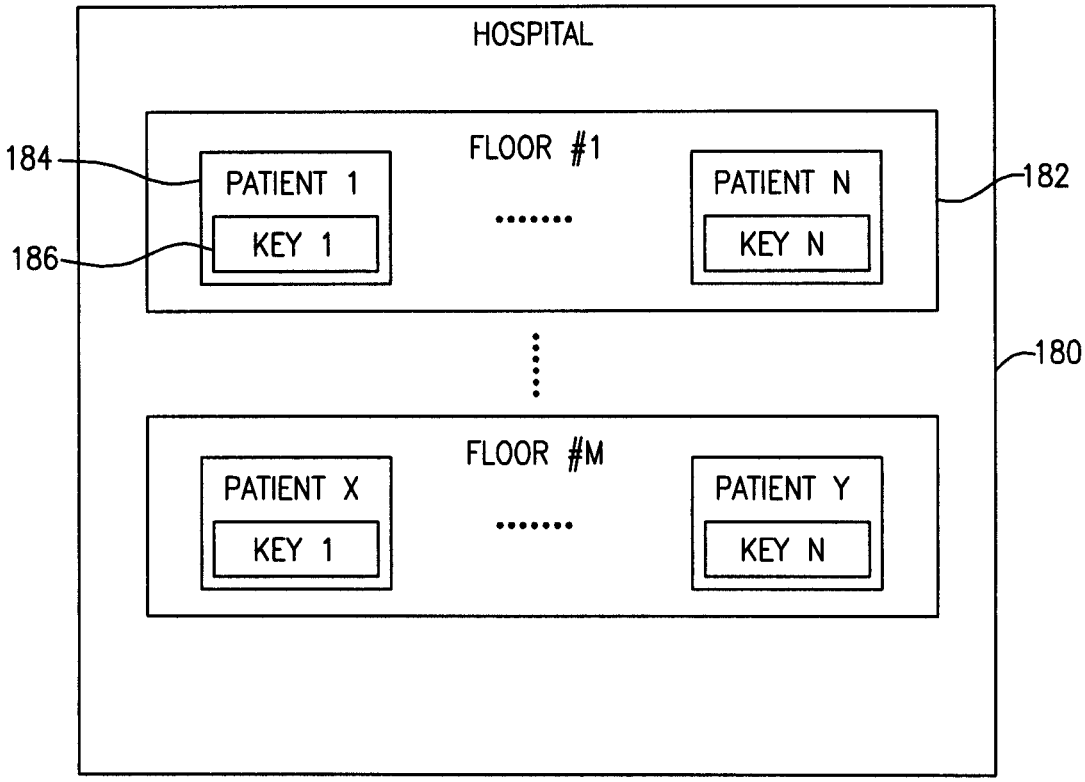
FIG. 8 illustrates a drug delivery system and related method according to a fourth embodiment in a hospital.

Although the above embodiments are illustrated utilizing a limited number of patients, keys and corresponding locking cap classes, it should be clear that any number of patients, keys and corresponding locking cap classes may be employed. Moreover, although the above embodiments provide a single unique key to each patient, such a strict one-to-one correlation is not necessarily required. For example, an arrangement as shown in FIG. 8 may be employed. A hospital 180 may have M floors 182, each with as many as N patients 184. The hospital 180 may distribute N keys 186 across each floor 182, providing one key 186 to each patient 184. Across each floor 182, the keys 186 may be unique to each other. However, identical copies of these keys 186 may be used for each floor 182. Hence, there may be M identical keys 186 across all of the floors 182, but across each floor 182 all of the keys 186 on that floor 182 are unique. Such an arrangement should be sufficient to discourage the use of one patient's key to open another patient's medication container.

Figure 9:
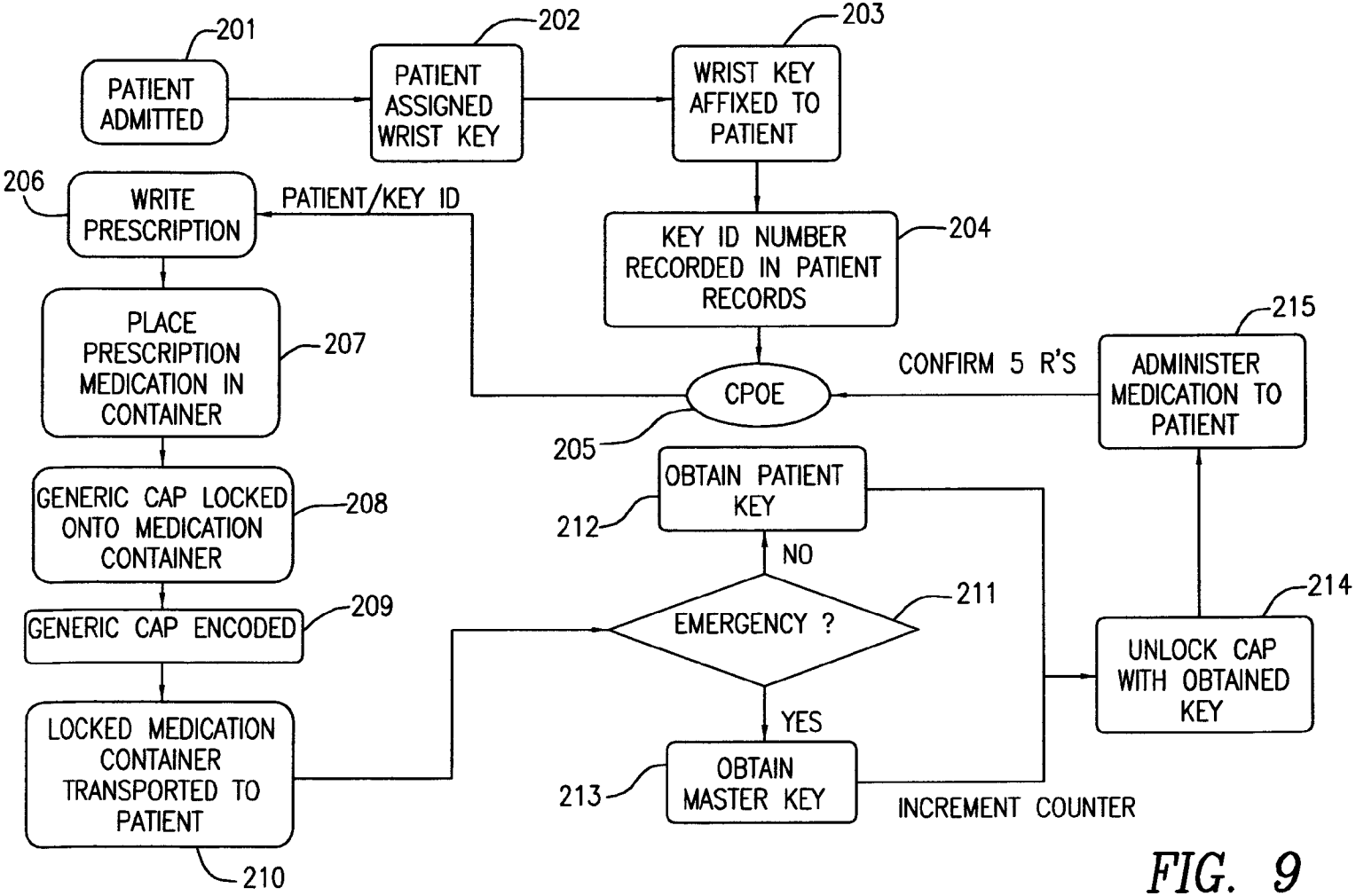
FIG. 9 is a flow chart of a drug delivery method according to one embodiment.

FIG. 9 provides a flow chart of an embodiment method of the present invention. In step 201 a patient is admitted into the hospital. This admission procedure may involve associating a patient ID with the name of the patient in the CPOE, and providing the patient with an identification bracelet. In step 202, a patient key is assigned to the patient, and in step 203 the patient key is attached to the identification bracelet or wrist of the patient. Finally, in step 204, the key ID number is recorded into the CPOE. In this manner, within the CPOE, the patient has an associated patient ID number and key ID number, with the key ID number corresponding to the key that was issued to the patient in steps 202 and 203.

When medication is to be prescribed to the patient, the doctor enters into the CPOE the type of medication to be delivered to the patient. The CPOE forwards this request to the pharmacy, providing the pharmacy with the patient ID number, and the key ID number associated with the patient. In step 206, the pharmacy uses this information to fill the prescription, and in step 207 the medication is placed into a suitable type of medication container. In step 208, a suitable type of template lock is selected and then used to lock the medication container, thereby restricting access to the medication filled in steps 206 and 207. In step 209, the cap encoder utilizes the key ID number to suitably encode the template cap, thereby converting the template cap into a locking cap that may be unlocked by the key issued to the patient in steps 202, 203. A nurse then delivers the locked medication container to the patient, as indicated in step 210.

Decision step 211 provides two alternate paths for unlocking the medication container. If an emergency exists and there is no easy access to the patient key, then the nurse may select the master key to unlock the medication container, as indicated ion step 213. In this case, the counter on the master lock increases. On the other hand, if no emergency situation exists, or the patient key is easily accessible, then the patient key may be used, as indicated in step 212. In step 214, either the master key or the patient key is used to unlock the medication container, thereby restoring access to the medication contained therein. Finally, as indicated in step 215, the medication may be removed from the unlocked container, administered to the patient, and confirmed to the CPOE.

While the foregoing is directed to embodiments of the present invention, other and further embodiments of the invention may be devised without departing from the basic scope thereof, and the scope thereof is to be determined by the claims that follow.

What is claimed is:

1. A medication control system comprising:

a plurality of unique keys, each key having a stem and a plurality of protrusions, each key being associable with a patient; and a plurality of locking caps configured to be locked to medication containers to restrict access to medication contained therein, each locking cap having an inner cap adapted to lock onto the medication container and an outer cap surrounding and rotatable about the inner cap, the outer cap having a plurality of depressions corresponding to at least one of the keys and a hole so that when the plurality of protrusions is inserted into the plurality of depressions the stem can contact the inner cap to unlock the locking cap.

2. The medication control system of claim 1 wherein each key is associated with only one patient.

3. The medication control system of claim 1 further comprising:

a plurality of identifiers, each of the identifiers associated with at least one of the plurality of keys;

a plurality of template locks; and a cap encoder capable of accepting the template locks and the identifiers and forming the locking caps from the template locks according to the identifiers.

4. The medication control system of claim 1 wherein each key comprises an affixing mechanism for affixing the key to the proximity of a patient.

5. The medication control system of claim 1 further comprising a master key given to medical staff capable of unlocking every locking cap by medical staff.

6. The medication control system of claim 5 wherein the master key comprises a counter for counting the number of times the master key is used.

7. The medication control system of claim 6 wherein the counter cannot be reset.

8. The medication control system of claim 5 wherein each locking cap is capable of being unlocked only by one of the keys and the master key.

9. The medication control system of claim 5 wherein the master key is configured to mechanically engage with the locking caps to unlock the locking caps.

10. The medication control system of claim 9 wherein the master key has a fewer or equal number of protrusions than any of the locking caps that the master key is capable of unlocking.

11. The medication control system of claim 10 wherein the master key has no protrusions.

* * * * *